US008465091B2

(12) United States Patent
Su

(10) Patent No.: US 8,465,091 B2
(45) Date of Patent: Jun. 18, 2013

(54) ADJUSTABLE OFFICE CHAIR

(76) Inventor: Ying-Chieh Su, Tainan (TW)

( * ) Notice: Subject to any disclaimer, the term of this patent is extended or adjusted under 35 U.S.C. 154(b) by 353 days.

(21) Appl. No.: 13/033,655

(22) Filed: Feb. 24, 2011

(65) Prior Publication Data

US 2012/0217780 A1 Aug. 30, 2012

(51) Int. Cl.
*A47C 13/00* (2006.01)

(52) U.S. Cl.
USPC ..... 297/108; 297/118; 297/111; 5/28; 5/35; 5/42

(58) Field of Classification Search
USPC ..... 297/423.3, 423.26, 283.1, 118, 108, 297/109, 111, 440.1, 440.14, 440.12, 440.11; 5/28, 30, 35, 37.1, 42, 613, 617
See application file for complete search history.

(56) References Cited

U.S. PATENT DOCUMENTS 1,413,279 A * 4/1922 James et al. ..... 297/11
4,473,254 A * 9/1984 Secon ..... 297/111
5,636,900 A * 6/1997 Wilkie et al. ..... 297/423.19
5,758,926 A * 6/1998 Wilkie et al. ..... 297/423.19
5,882,083 A * 3/1999 Robinson ..... 297/440.2
6,739,651 B1 * 5/2004 Barefoot ..... 297/118
2007/0169270 A1 * 7/2007 Chai ..... 5/620
2009/0127892 A1 * 5/2009 Chen ..... 297/118
2010/0190623 A1 * 7/2010 Guissin et al. ..... 482/142
2011/0010859 A1 * 1/2011 Teeter ..... 5/616
2011/0272200 A1 * 11/2011 Clapp et al. ..... 180/54.1

* cited by examiner

*Primary Examiner* — David Dunn
*Assistant Examiner* — Alexander Harrison
(74) *Attorney, Agent, or Firm* — Panitch Schwarze Belisario & Nadel LLP

(57) ABSTRACT

An adjustable office chair includes a base device, and a seat device disposed on the base device. The seat device includes a fixed seat section, a rear seat section connected pivotally to and disposed behind the fixed seat section, a front seat section connected pivotally to and disposed in front of the fixed seat, and an invertible seat section connected pivotally to a side of the front seat section distal from the fixed seat section. The invertible seat section is movable to a position directly above the fixed seat section to allow a user to sit thereon. The front and invertible seat sections are movable to align with the fixed seat section to allow the user to sit on the fixed seat section. The rear seat section is movable to an inclined position to allow the user to lie on the seat device.

10 Claims, 5 Drawing Sheets

ADJUSTABLE OFFICE CHAIR

BACKGROUND OF THE INVENTION

1. Field of the Invention

This invention relates to an office chair, and more particularly to an office chair that includes a seat device adjustable to allow the whole legs of a user to straighten and rest thereon.

2. Description of the Related Art

An adjustable backrest has been proposed to be disposed on an office chair. Such an adjustment to an office chair, however, is no longer sufficient to meet the needs of consumers. To provide an enhanced comfort to a user, it is desirable that an office chair can be adjusted to allow the whole legs of the user to straighten and rest on a seat of the office chair, when desired.

SUMMARY OF THE INVENTION

The object of this invention is to provide an office chair that includes a seat device adjustable to allow the whole legs of a user to straighten and rest thereon.

Accordingly, an adjustable office chair of this invention includes a base device, and a seat device disposed on the base device. The seat device includes a fixed seat section, a rear seat section connected pivotally to and disposed behind the fixed seat section, a front seat section connected pivotally to and disposed in front of the fixed seat, and an invertible seat section connected pivotally to a side of the front seat section distal from the fixed seat section. The invertible seat section is movable to a position directly above the fixed seat section to allow a user to sit thereon. The front and invertible seat sections are movable to align with the fixed seat section to allow the user to sit on the fixed seat section, in such a manner to straighten and rest the whole legs of the user on the front and invertible seat sections. The rear seat section is movable to an inclined position to allow the user to lie on the seat device.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
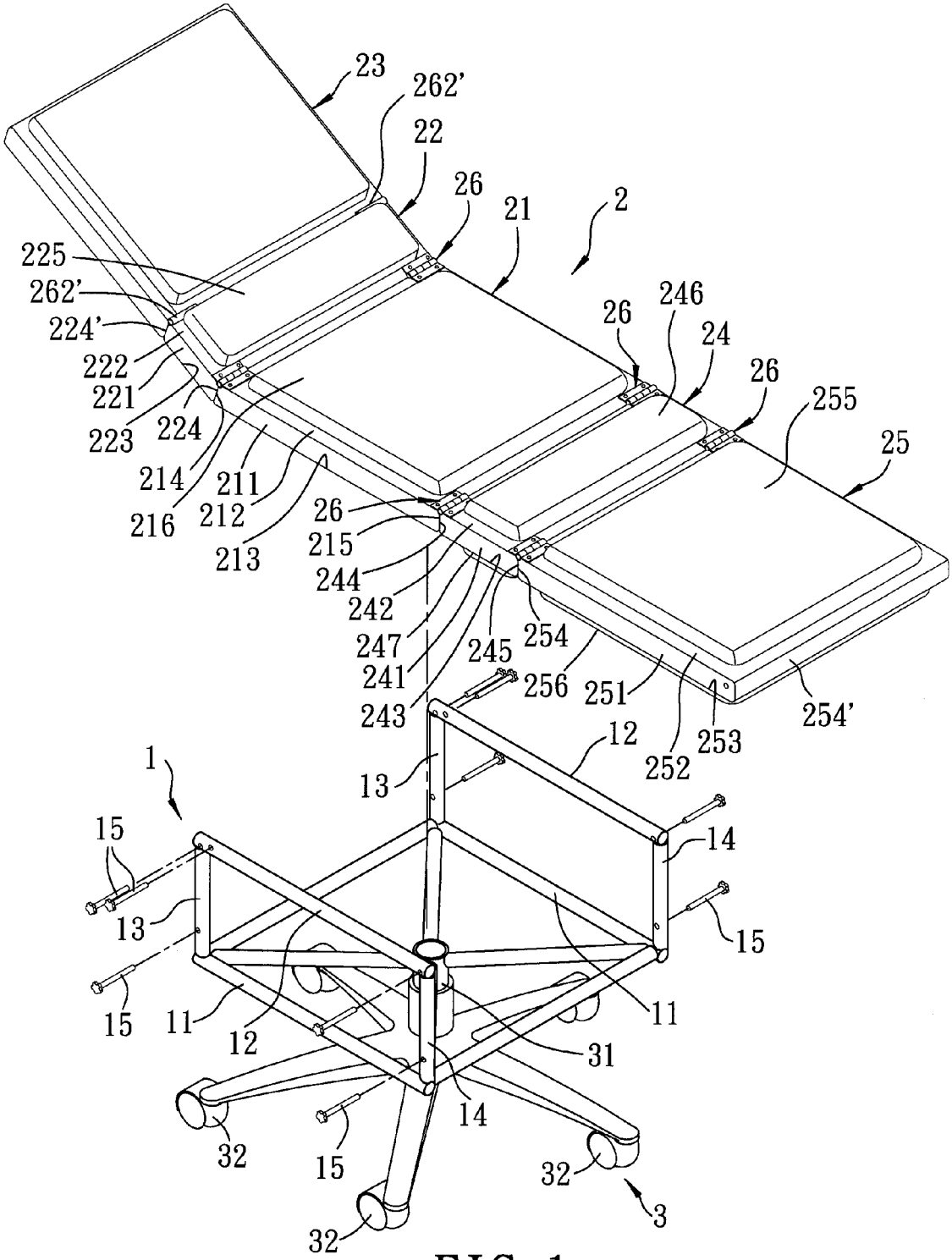
FIG. 1 is a partly exploded perspective view of the preferred embodiment of an adjustable office chair according to this invention.
Figure 2:
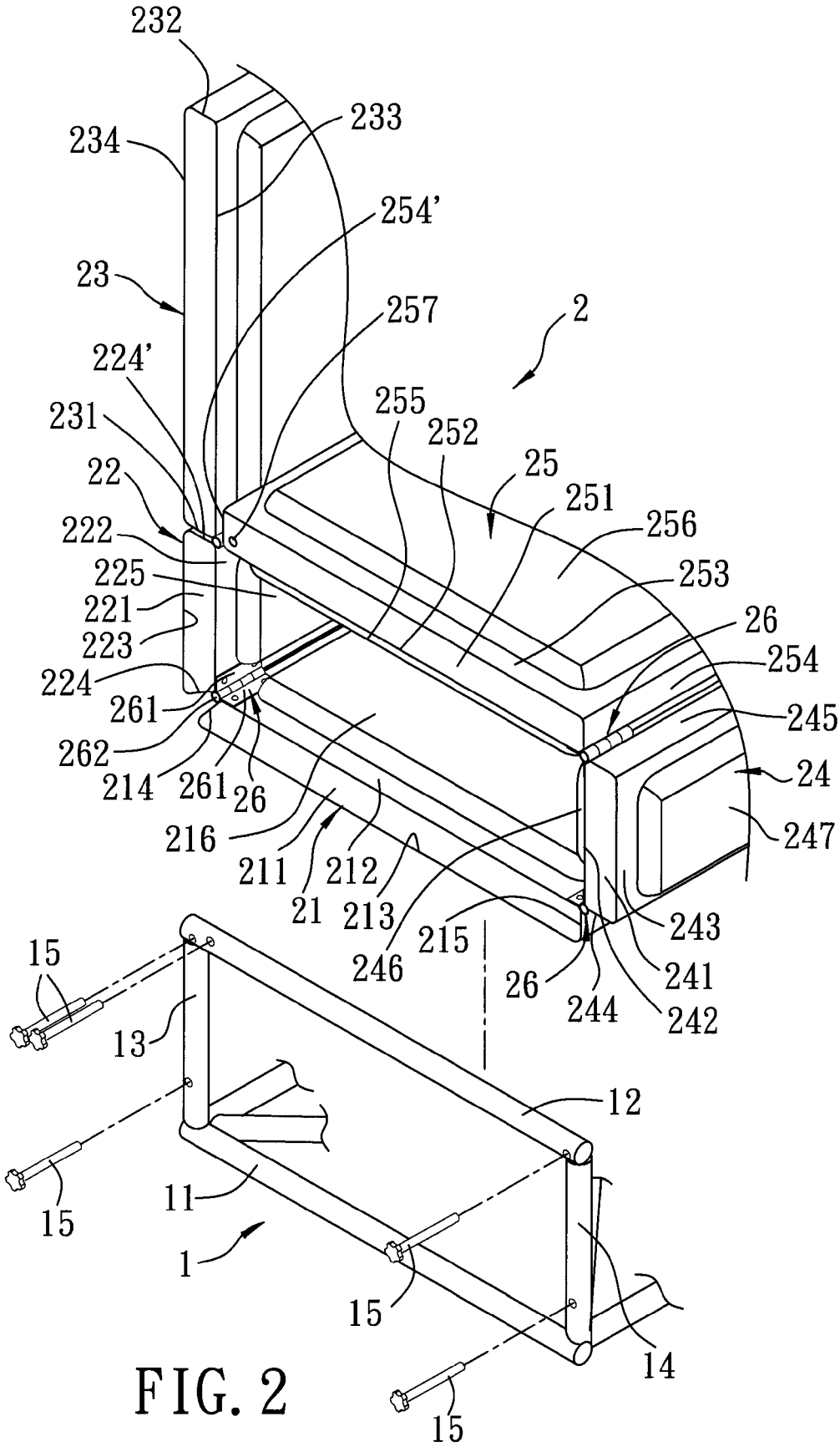
FIG. 2 is a fragmentary, partly exploded perspective view of the preferred embodiment.

Referring to FIGS. 1 and 2, the preferred embodiment of an adjustable office chair according to this invention includes a base device 1, a seat device 2 disposed adjustably on the base device 1, and a leg device 3 mounted on and under the base device 1.

The base device 1 is generally U-shaped, is open forwardly, rearwardly, and upwardly, and includes two bottom side portions 11 opposite to each other in a left-to-right direction, two top side portions 12 opposite to each other in the left-to-right direction and disposed above and spaced apart from the bottom side portions 11, two rear side portions 13 opposite to each other in the left-to-right direction and each connected between rear ends of the corresponding bottom side portion 11 and the corresponding top side portion 12, and two front side portions 14 opposite to each other in the left-to-right direction and each connected between front ends of the corresponding bottom side portion 11 and the corresponding top side portion 12. In this embodiment, the base device 1 is comprised of a plurality of metal rods, and each of the bottom side portions 11, the top side portions 12, the rear side portions 13, and the front side portions 14 is configured as a metal rod. To reinforce the base device 1, a plurality of connecting rods (not shown) may be connected between the bottom side portions 11. In one alternative embodiment, the base device 1 may include a horizontal bottom plate and two vertical side plates disposed respectively on two opposite sides of the horizontal bottom plate. In another alternative embodiment, an assembly of the bottom side portion 11, the top side portion 12, the rear side portion 13, and the front side portion 14 at the same side is configured as a rectangular frame, and is formed by bending a metal rod. If necessary, a pair of left and right armrests (not shown) can be mounted to the base device 1.

The base device 1 further includes two sets of engaging members 15 that are disposed respectively at left and right sides of base device 1 and that are inserted removably into an assembly of the top, rear, and front side portions 12, 13, 14. Each of the engaging members 15 is configured as an insert pin. An anti-drop unit (not shown) may be connected between each of the engaging members 15 and a corresponding one of the top, rear, and front side portions 12, 13, 14 for preventing removal of the corresponding engaging member 15 from the corresponding one of the top, rear, and front side portions 12, 13, 14. For example, the anti-drop unit may be a bead string, a cord, or a spring-loaded retainer. Alternatively, the number or positions of the engaging members 15 may be changed.

The seat device 2 includes a fixed seat section 21 disposed fixedly between the bottom side portions 11, a rear seat section 22 connected pivotally to a rear side of the fixed seat portion 21 and mounted removably between the rear side portions 13, a backrest seat section 23 extending from a side of the rear seat section 22 distal from the fixed seat section 21, a front seat section 24 connected pivotally to a front side of the fixed seat section 21, and an invertible seat section 25 connected pivotally to a side of the front seat section 24 distal from the fixed seat section 21.

The fixed seat section 21 includes a flat, rectangular main body 211. The main body 211 has opposite top and bottom surfaces 212, 213, and opposite front and rear side surfaces 215, 214. The top and bottom surfaces 212, 213 are parallel to each other. The front side surface 215 is perpendicular to the top and bottom surfaces 212, 213. The rear side surface 214 is inclined relative to the top and bottom surfaces 212, 213, and extends rearwardly and downwardly from a rear end of the top surface 212. The rear seat section 22 includes a flat, rectangular main body 221. The main body 221 has a proximate side surface 224 proximate to the rear side surface 214 of the fixed seat section 21, a distal side surface 224' opposite to the proximate side surface 224 and distal from the rear side surface 214 of the fixed seat section 21, and opposite inner and outer side surfaces 222, 223 interconnecting and perpendicular to the proximate and distal side surfaces 224, 224'. The backrest seat section 23 has a proximate side surface 231 proximate to the distal side surface 224' of the rear seat section 22, a distal side surface 232 opposite to the proximate side surface 231 and distal from the distal side surface 224' of the rear seat section 22, and inner and outer side surfaces 233, 234 interconnecting and perpendicular to the proximate side surface 231 and the distal side surface 232. The front seat section 24 includes a flat, rectangular main body 241. The main body 241 has a proximate side surface 244 proximate to the front side surface 215 of the fixed seat section 21, a distal side surface 245 opposite to the proximate side surface 244 and distal from the front side surface 215 of the fixed seat section 21, and opposite inner and outer side surfaces 242, 243 interconnecting and perpendicular to the proximate and distal side surfaces 244, 245. The invertible seat section 25 includes a flat, rectangular main body 251. The main body 251 has a proximate side surface 254 proximate to the distal side surface 245 of the front seat section 24, a distal side surface 254' opposite to the proximate side surface 254 and distal from the distal side surface 245 of the front seat section 24, and opposite inner and outer side surfaces 252, 253 interconnecting and perpendicular to the proximate and distal side surfaces 254, 254'.

The fixed seat section 21 further includes a cushion 216 disposed on the top surface 212. The rear seat section 22 further includes a cushion 225 disposed on the inner side surface 222. The front seat section 24 further includes an inner cushion 246 disposed on the inner side surface 242, and an outer cushion 247 disposed on the outer side surface 243. The invertible seat section 25 further includes an inner cushion 255 disposed on the inner side surface 252, and an outer cushion 256 disposed on the outer side surface 253. Peripheries of the main bodies 211, 221, 241, 251 of the fixed seat section 21, the rear seat section 22, the front seat section 24, and the invertible seat sections 25 are rigid. Each of the main bodies 211, 221, 241, 251 of the fixed seat section 21, the rear seat section 22, the front seat section 24, and the invertible seat sections 25 can be manufactured by mounting a plate or rod to each side of a foam and subsequently covering the plate or rod with a cloth strip, or by securing a resilient net cloth within a rigid rectangular frame. Alternatively, the cushions 216, 225, 246, 247, 255, 256 may be omitted.

The seat device 2 further includes a plurality of pairs of pivotal connection units 26. Each adjacent pair of the fixed seat section 21, the rear seat section 22, the front seat section 24, and the invertible seat section 25 is interconnected pivotally by a corresponding pair of the pivot connection units 26. Each of the pivotal connection units 26 includes two wing plates 261 fastened respectively to a corresponding pair of the fixed seat section 21, the rear seat section 22, the front seat section 24, and the invertible seat section 25, and a pivot shaft 262 extending rotatably through the wing plates 261. The rear seat section 22 is connected pivotally to the backrest seat section 23 by a pivot shaft 262' (see FIG. 1). Alternatively, the rear seat section 22 may be formed integrally with the backrest seat portion 23, or connected to the backrest section portion 23 by two additional pivotal connection units 26 in such a manner to allow for an adjustment in an inclination angle of the backrest seat section 23 relative to the rear seat section 22.

In this embodiment, each set of the engaging members 15 (i.e., at the same side) includes a first one inserted removably into the corresponding rear side portion 13 and the pivot shaft 262 of the corresponding pivot connection unit 26 interconnecting the rear seat section 22 and the fixed seat section 21, a second one inserted removably into the corresponding front side portion 14 and the pivot shaft 262 of the corresponding pivot connection unit 26 interconnecting the front seat section 24 and the fixed seat section 21, a third one inserted removably into a front end of the corresponding top side portion 12 and the pivot shaft 262 of the corresponding pivot connection unit 26 interconnecting the invertible seat section 25 and the front seat section 24, a fourth one inserted removably into a rear end of the corresponding top side portion 12, and a fifth one adjacent to and spaced apart from the fourth one and inserted removably into the rear end of the corresponding top side portion 12.

The leg device 3 is used to support the base device 1 and the seat device 2 on a support surface, such as the ground surface, and includes a support post unit 31 mounted on and under the base device 1, and a plurality of casters 32 mounted to a bottom end of the support post unit 31. The support post unit 31 can be designed as a telescopic tube unit.

Figure 3:
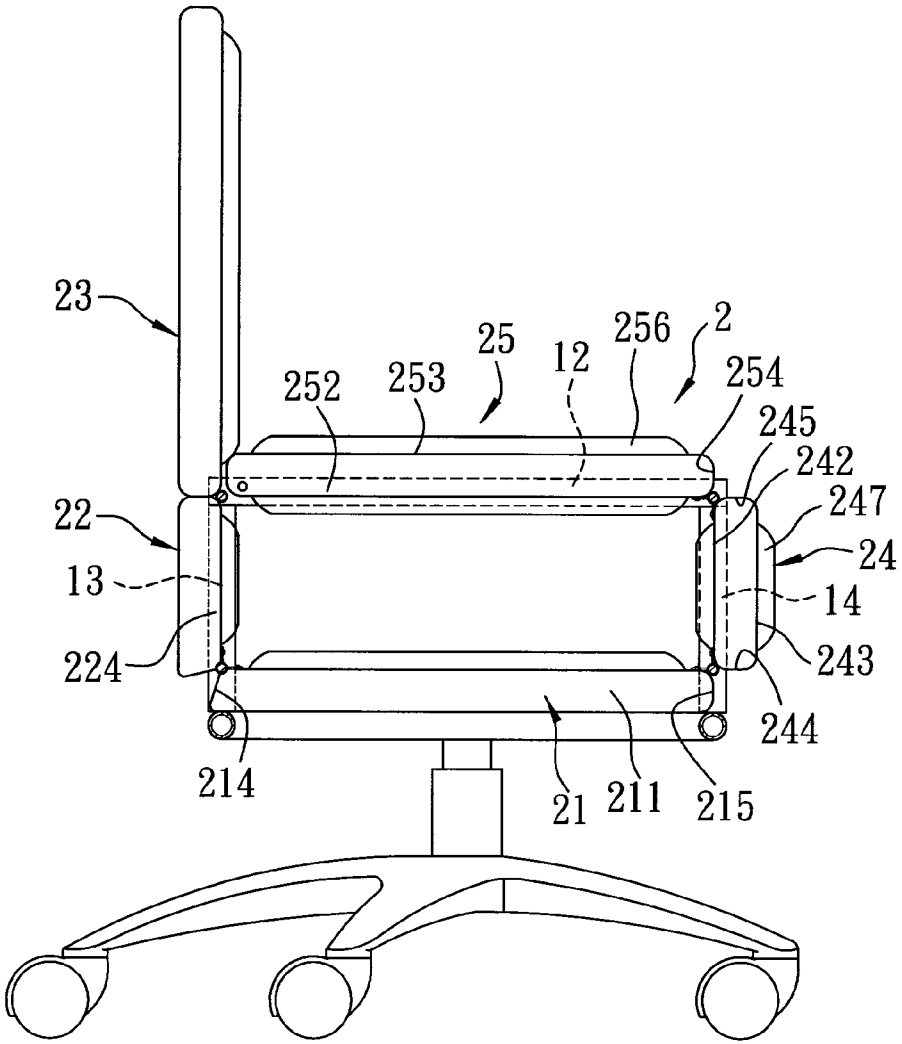
FIG. 3 is a side view of the preferred embodiment, illustrating that a seat device is in a first state.
Figure 4:
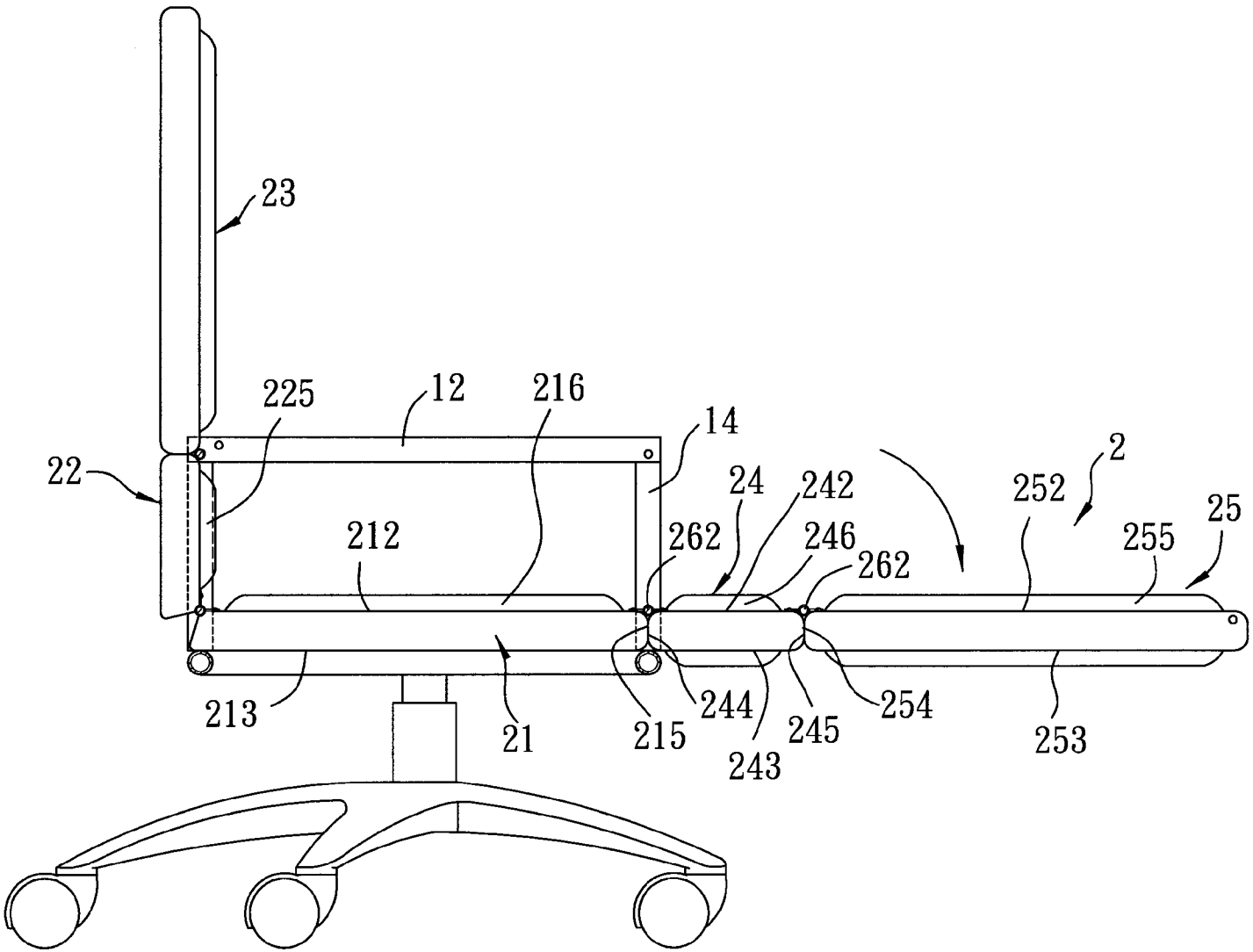
FIG. 4 is a view similar to FIG. 3 but illustrating that the seat device is in a second state.
Figure 5:
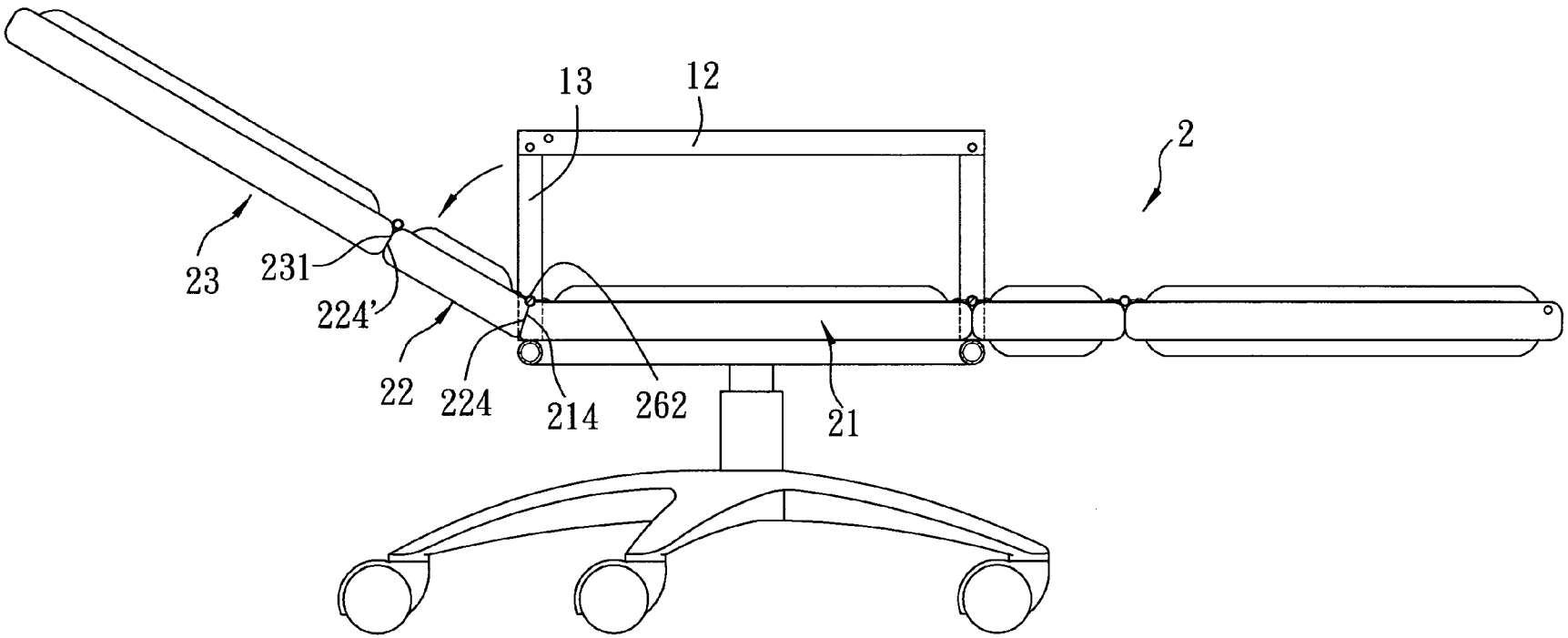
FIG. 5 is a view similar to FIG. 3 but illustrating that the seat device is in a third state.

The seat device 2 is convertible among a first state shown in FIGS. 2 and 3, a second state shown in FIG. 4, and a third state shown in FIG. 5. With particular reference to FIGS. 2 and 3, when the seat device 2 is in the first state, the rear seat section 22 is disposed uprightly between the rear side portions 13 such that the inner side surface 222 faces forwardly and the outer side surface 223 faces rearwardly (see FIG. 2), the backrest seat section 23 is disposed uprightly and directly above the rear seat section 22, the front seat section 24 is disposed uprightly between the front side portions 14, and the invertible seat section 25 is disposed horizontally between the top side portions 12. Also in the first state, the rear side surface 214 of the fixed seat section 21 is spaced apart from the proximate side surface 224 of the rear seat section 22, the front side surface 215 of the fixed seat section 21 is spaced apart from the proximate side surface 244 of the front seat section 24, the distal side surface 245 of the front seat section 24 is spaced apart from the proximate side surface 254 of the invertible seat section 25, the outer side surface 243 of the front seat section 243 faces forwardly, and the outer side surface 253 of the invertible seat section 25 faces upwardly. As such, a user can sit on the invertible seat section 25, in such a manner that his or her feet are suspended from the invertible seat section 25. The seat device 2 can be maintained in the first state by inserting the third, fourth, and fifth engaging members 15 through the top side portions 12 and into the seat device 2, such that the third engaging members 15 extend respectively into the pivot shafts 262 disposed between the invertible seat section 25 and the front seat section 24, the fourth engaging members 15 extend respectively into two holes 257 (only one is shown in FIG. 2) in the invertible seat section 25, and the fifth engaging members 16 extend respectively into the pivot shafts 15 disposed between the rear seat section 22 and the backrest section 23.

With particular reference to FIGS. 1 and 4, when it is desired to convert the seat device 2 from the first state into the second state, the third engaging members 15 disposed between the invertible seat section 25 and the front seat section 24 and the fourth engaging members 15 inserted respectively into the holes 257 in the invertible seat section 25 are first removed from the seat device 2 and the top side portions 12. Next, an assembly of the invertible seat section 25 and the front seat section 24 is moved relative to the fixed seat section 21 to a horizontal position shown in FIG. 4 whereat the seat device 2 is in the second state, such that the front seat section 24 is spaced apart from the front side portions 14 and extends forwardly from the fixed seat section 21, and the invertible seat section 25 is spaced apart from the top side portions 12 and extends forwardly from the front seat section 24. As such, the inner side surfaces 242, 252 of the front seat section 24 and the invertible seat section 25 are aligned with the top surface 212 of the fixed seat section 21, and the outer side surfaces 243, 253 of the front seat section 24 and the invertible seat section 25 face downwardly, and are aligned with the bottom surface 213 of the fixed seat section 21. In the second state, since the proximate side surface 244 and the distal side surface 245 of the front seat section 24 abut respectively against the front side surface 215 of the fixed seat section 21 and the proximate side surface 254 of the invertible seat section 25, the assembly of the invertible seat section 25 and the front seat section 24 can be maintained in the horizontal position. As such, the user can sit on the fixed seat section 21, in such a manner that his or her feet rest on the front seat section 24 and the invertible seat section 25.

With particular reference to FIGS. 1 and 5, when it is desired to convert the seat device 2 from the second state to the third state, the fifth engaging members 15 are first removed from the seat device 2 and the top side portions 12. Next, an assembly of the backrest seat section 23 and the rear seat section 22 is pivoted rearwardly about the pivot shafts 262 disposed between the rear seat section 22 and the fixed seat section 21, until the proximate side surface 224 and the distal side surface 224' of the rear seat section 22 abut respectively against the rear side surface 214 of the fixed seat section 21 and the proximate side surface 231 of the backrest seat section 23, so that the seat device 2 is in the third state. In the third state, the rear seat section 22 is inclined, and extends rearwardly and upwardly from the fixed seat section 21. Also in the third state, the backrest seat section 23 is aligned with the rear seat section 22, so as to allow the user to lie on the seat device 2, in such a manner that a back of the user rests on the assembly of the backrest seat section 23 and the rear seat section 22. Preferably, in the third state, an angle of 150 to 160 degrees is formed between the inner side surface 222 of the rear side section 22 and the top surface 212 of the fixed seat section 21, thereby improving user comfort.

In view of the above, the front and rear seat sections 24, 22 are pivotable relative to the fixed seat section 21, and the invertible seat section 25 is pivotable relative to the front seat section 24. When the seat device 2 is in the first state, as shown in FIG. 3, the assembly of the rear seat section 24 and the invertible seat section 25 is inverted L-shaped, and the invertible seat section 25 is disposed directly above the fixed seat section 21. In this state, the user can sit on the invertible seat section 25 in such a manner to allow his or her feet to contact the support surface. When the seat device 2 is in the second state, as shown in FIG. 4, the front seat section 24 and the invertible seat section 25 are horizontal, and are disposed in front of the fixed seat section 21. In this state, the user can sit on the fixed seat section 21 in such a manner to allow his or her feet to rest on the front seat section 24 and the invertible seat section 25. When the seat device 2 is in the third state, the rear seat section 22 and the backrest seat section 23 are inclined so as to allow the user to lie on the seat device 2. Since the front seat section 24 and the invertible seat section 25 cooperate with the fixed seat section 21 to support the whole feet of the user in such a manner to straighten the feet when the seat device 2 is in the second or third state, an enhanced comfort can be provided to the user. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. An office chair comprising:

a base device including two bottom side portions opposite to each other in a left-to-right direction, two top side portions opposite to each other in the left-to-right direction and disposed above and spaced apart from said bottom side portions, two rear side portions opposite to each other in the left-to-right direction and each connected between a rear end of a corresponding one of said bottom side portions and a rear end of a corresponding one of said top side portions, and two front side portions opposite to each other in the left-to-right direction and each connected between a front end of the corresponding one of said bottom side portions and a front end of the corresponding one of said top side portions;

a seat device including a fixed seat section disposed fixedly between said bottom side portions and having opposite front and rear sides, a rear seat section connected pivotally to said rear side of said fixed seat section, a front seat section connected pivotally to said front side of said fixed seat section, and an invertible seat section connected pivotally to a side of said front seat section distal from said fixed seat section; and a leg device mounted on and under said base device and adapted to be disposed on a support surface;

wherein said seat device is convertible among a first state, where said rear seat section is disposed uprightly and removably between said rear side portions, where said front seat section is disposed uprightly and removably between said front side portions, and where said invertible seat section is disposed horizontally and removably between said top side portions, so as to allow a user to sit thereon, in such a manner that feet of the user are suspended from said invertible seat section, a second state, where said rear seat section is disposed uprightly and removably between said rear side portions, where said front seat section is spaced apart from said front side portions and extends forwardly from said fixed seat section, and where said invertible seat section is spaced apart from said top side portions and extends forwardly from said front seat section, so as to allow the user to sit on said fixed seat section, in such a manner that the feet of the user rest on said front seat section and said invertible seat section, and a third state, where each of said front seat section and said invertible seat section is at a position the same as that in the second state, and where said rear seat section is inclined, and extends rearwardly and upwardly from said fixed seat section, so as to allow the user to lie on said seat device, in such a manner that a back of the user rests on said rear seat section.

2. The office chair as claimed in claim 1, wherein said seat device further includes a plurality of pairs of pivotal connection units, any two adjacent ones of said fixed seat section, said front seat section, said rear seat section, and said invertible seat section being interconnected pivotally by a corresponding pair of said pivot connection units.

3. The office chair as claimed in claim 2, wherein each of said pivotal connection units includes:

two wing plates fastened respectively to the two adjacent ones of said fixed seat section, said front seat section, said rear seat section, and said invertible seat section; and a pivot shaft extending rotatably through said wing plates.

4. The office chair as claimed in claim 3, wherein said pivot shaft of each of said pivotal connection units is tubular, said base device including two first engaging members each connected removably to said rear seat section and a respective one of said rear side portions, two second engaging members each connected removably to said front seat section and a respective one of said front side portions, and two third engaging members each connected removably to said invertible seat section and a respective one of said top side portions.

5. The office chair as claimed in claim 3, wherein said base device further includes two first engaging members each inserted removably into said base device and a corresponding one of said pivot shafts of said pivotal connection units interconnecting said rear seat section and said fixed seat section, two second engaging members each inserted removably into said base device and a corresponding one of said pivot shafts of said pivotal connection units interconnecting said fixed seat section and said front seat section, and two third engaging members each inserted removably into said base device and a corresponding one of said pivot shafts of said pivotal connection units interconnecting said front seat section and said invertible seat section, so as to connect removably said front seat section, said rear seat section, and said invertible seat section to said base device.

6. The office chair as claimed in claim 2, wherein:

said fixed seat section includes a flat, rectangular main body, said main body of said fixed seat section having opposite top and bottom surfaces that are parallel to each other, and opposite front and rear side surfaces, said front side surface being perpendicular to said top and bottom surfaces, said rear side surface being inclined relative to said top and bottom surfaces and extending rearwardly and downwardly from a rear end of said top surface;

said rear seat section includes a flat, rectangular main body, said main body of said rear seat section having a proximate side surface proximate to said rear side surface of said fixed seat section, a distal side surface opposite to said proximate side surface of said rear seat section and distal from said rear side surface of said fixed seat section, an inner side surface facing forwardly when said seat device is in either the first or second state, and an outer side surface facing rearwardly when said seat device is in either the first or second state, said inner and outer side surfaces of said rear seat section being perpendicular to said proximate and distal side surfaces of said rear seat section;

said front seat section includes a flat, rectangular main body, said main body of said front seat section having a proximate side surface proximate to said front side surface of said fixed seat section, a distal side surface opposite to said proximate side surface of said front seat section and distal from said front side surface of said fixed seat section, an inner side surface aligned with said top surface of said fixed seat section when said seat device is in either the second or third state, and an outer side surface opposite to said inner side surface of said front seat section and aligned with said bottom surface of said fixed seat section when said seat device is in either the second or third state, said inner and outer side surfaces of said front seat section being perpendicular to said proximate and distal side surfaces of said front seat section;

said invertible seat section includes a flat, rectangular main body, said main body of said invertible seat section having a proximate side surface proximate to said distal side surface of said front seat section, a distal side surface opposite to said proximate side surface of said invertible seat section and distal from said distal side surface of said front seat section, an inner side surface aligned with said inner side surface of said front seat section when said seat device is in either the second or third state, and an outer side surface opposite to said inner side surface of said invertible seat section and aligned with said outer side surface of said front seat section when said seat device is in either the second or third state, said inner and outer side surfaces of said invertible seat section being perpendicular to said proximate and distal side surfaces of said invertible seat section;

any two adjacent ones of said top surface of said fixed seat section, and said inner side surfaces of said front seat section, said rear seat section, and said invertible seat section are interconnected pivotally by a corresponding pair of said pivotal connection units;

when said seat device is in the first state, said rear side surface of said fixed seat section is spaced apart from said proximate side surface of said rear seat section, said front side surface of said fixed seat section is spaced apart from said proximate side surface of said front seat section, said distal side surface of said front seat section is spaced apart from said proximate side surface of said invertible seat section, said outer side surface of said front seat section faces forwardly, and said outer side surface of said invertible seat section faces upwardly;

when said seat device is in the second state, said proximate side surface of said front seat section abuts against said front side surface of said fixed seat section, said proximate side surface of said invertible seat section abuts against said distal side surface of said front seat section, and said outer side surfaces of said front seat section and said invertible seat section face downwardly; and when said seat device is in the third state, the proximate side surface of said rear seat section abuts against said rear side surface of said fixed seat section.

7. The office chair as claimed in claim 5, wherein, when said seat device is in the third state, an angle of 150 to 160 degrees is formed between said inner side surface of said rear seat section and said top surface of said fixed seat section.

8. The office chair as claimed in claim 5, wherein:

said fixed seat section further includes a cushion disposed on said top surface of said main body of said fixed seat section;

said rear seat section further includes a cushion disposed on said inner side surface of said main body of said rear seat section;

said front seat section further includes two cushions disposed respectively on said inner and outer side surfaces of said main body of said front seat section; and said invertible seat section further includes two cushions disposed respectively on said inner and outer side surfaces of said main body of said invertible seat section.

9. The office chair as claimed in claim 1, wherein said seat device further includes a backrest seat section extending from a side of said rear seat section distal from said fixed seat section and aligned with said rear seat section.

10. The office chair as claimed in claim 1, wherein said leg device includes a support post unit mounted on and under said base device, and a plurality of casters mounted to a bottom end of said support post unit.

* * * * *